US009938113B2

(12) United States Patent
Maleck et al.

(10) Patent No.: US 9,938,113 B2
(45) Date of Patent: Apr. 10, 2018

(54) METHOD FOR OPERATING A WORK STATION OF A SPINNING OR WINDING MACHINE, AND A CORRESPONDING WORK STATION

(71) Applicant: Rieter Ingolstadt GmbH, Ingolstadt (DE)

(72) Inventors: Mario Maleck, Walting (DE); Thomas Gruber, Ingolstadt (DE); Robin Wein, Ingolstadt (DE); Christian Kettner, Koesching (DE)

(73) Assignee: Rieter Ingolstadt GmbH, Ingolstadt (DE)

( * ) Notice: Subject to any disclaimer, the term of this patent is extended or adjusted under 35 U.S.C. 154(b) by 0 days.

(21) Appl. No.: 15/271,484

(22) Filed: Sep. 21, 2016

(65) Prior Publication Data

US 2017/0081142 A1 Mar. 23, 2017

(30) Foreign Application Priority Data

Sep. 21, 2015 (DE) ..... 10 2015 115 919

(51) Int. Cl.
*B65H 51/16* (2006.01)
*B65H 54/22* (2006.01)
(Continued)

(52) U.S. Cl.
CPC ..... *B65H 51/16* (2013.01); *B65H 51/10* (2013.01); *B65H 54/22* (2013.01); *B65H 54/30* (2013.01);
(Continued)

(58) Field of Classification Search
CPC ..... D01H 9/02; B65H 51/16; B65H 54/22; B65H 54/24; B65H 54/26; B65H 54/707;
(Continued)

(56) References Cited

U.S. PATENT DOCUMENTS 4,501,116 A 2/1985 Schuller et al.
2002/0023422 A1 2/2002 Stephan et al.

FOREIGN PATENT DOCUMENTS

DE 26 22 300 A1 12/1976
DE 100 41 973 A1 3/2002
(Continued)

OTHER PUBLICATIONS

German Search Report, dated Jun. 28, 2016.
EP Search Report, dated Feb. 2, 2017.

*Primary Examiner* — William E Dondero
(74) *Attorney, Agent, or Firm* — Dority & Manning, P.A.

(57) ABSTRACT

A method is provided for operating a work station of a spinning or winding machine, wherein the work station includes a spinning device for producing a thread or a cop for delivering a thread, and a winding device for producing a bobbin on a tub. The winding device includes a swivel-mounted bobbin holder with a bobbin plate for receiving the tube and for catching the thread, a powered winding roller for rotating the tube or a bobbin, and a thread traversing device. A first suction nozzle is directed towards a circumference of a bobbin on the bobbin holder, and a second suction nozzle is arranged on the bobbin plate turned away from the bobbin and spaced from and directed counter to the first suction nozzle. To attaching a thread to an empty tube placed on the bobbin holder, the thread is arranged in the first and second suction nozzles so that the thread is tensed by negative pressure at least in the second suction nozzle. Subsequently, the tensed thread is captured between the first and second suction nozzles with a catching device in order to catch the thread for subsequent winding onto the empty tube.

17 Claims, 9 Drawing Sheets

(51) Int. Cl.

| | |
|---|---|
| ***D01H 9/02*** | (2006.01) |
| ***B65H 67/04*** | (2006.01) |
| ***B65H 65/00*** | (2006.01) |
| ***B65H 54/30*** | (2006.01) |
| ***B65H 51/10*** | (2006.01) |

(52) U.S. Cl.
CPC ..... *B65H 65/00* (2013.01); *B65H 67/04* (2013.01); *D01H 9/02* (2013.01); *B65H 2701/31* (2013.01)

(58) Field of Classification Search
CPC ..... B65H 54/86; B65H 54/88; B65H 65/00; B65H 67/04; B65H 67/0411; B65H 67/0471; B65H 67/0422
See application file for complete search history.

(56) References Cited

FOREIGN PATENT DOCUMENTS

| | | | |
|---|---|---|---|
| DE | 10 2012 008 691 | A1 | 10/2013 |
| EP | 0 069 205 | A1 | 1/1983 |

METHOD FOR OPERATING A WORK STATION OF A SPINNING OR WINDING MACHINE, AND A CORRESPONDING WORK STATION

FIELD OF THE INVENTION

The invention relates to a method for operating a work station of a spinning machine and/or a winding machine, which has a spinning device for producing a thread or a cop for delivering a thread along with a winding device for producing a package on a tube. The winding device features a swivel-mounted bobbin holder with a bobbin plate for receiving the tube and for catching the thread, a powered winding roller for rotating the tube and/or the bobbin along with a thread traversing device. The work station is equipped with a first suction nozzle that is directed towards the bobbin circumference and also with a second suction nozzle that is arranged on the side of the bobbin plate turned away from the package and is directed essentially counter to the first suction nozzle and is spaced apart from it. The invention also relates to a corresponding work station of a spinning machine and/or winding machine.

BACKGROUND

DE 10 2012 008 691 A1 discloses a method for operating work stations of an open-end rotor spinning machine and a corresponding work station for performing the method, with which a first, swivel-mounted suction nozzle and a second, movably mounted suction nozzle are provided. The first, swivel-mounted suction nozzle picks up a thread from a package and passes the thread to the work station in the area of the spinning device. Upon reaching a predetermined diameter of the package, the winding process is interrupted and a change of the package/tube is initiated. Herein, the produced thread is disposed of through the second suction nozzle, which is positionable as required. The movably mounted second suction nozzle is positioned upon the transfer of the incoming thread to an empty tube in such a manner that the thread can be held in the suitable position. The disadvantage here is that two movably mounted suction nozzles are required. Thereby, the construction expense of the storage of the suction nozzles that is necessary for this is elaborate, and requires a high control effort. In addition, the movement of the suction nozzles is time-consuming and is detrimental to the productivity of the work station.

SUMMARY OF THE INVENTION

A task of the present invention is to provide a method and a device with which a thread can be attached to an empty tube of a spinning machine and/or a winding machine quickly and with structural simplicity. Additional objects and advantages of the invention will be set forth in part in the following description, or may be obvious from the description, or may be learned through practice of the invention.

The tasks are solved with a method and a work station in accordance with the characteristics described herein.

The method in accordance with the invention for operating a work station of a spinning machine and/or a winding machine is used to attach a thread to an empty tube. A suitable spinning machine may be an open-end rotor spinning machine or an air jet spinning machine. Moreover, a winding machine, which features a cop instead of a spinning device for producing a thread, from which the thread is delivered and is wound on a package, is suitable for applying the method in accordance with the invention. The work station has a spinning device for producing a thread or a cop for delivering a thread along with a winding device for producing a package on a tube. The winding device features a swivel-mounted bobbin holder with a bobbin plate for receiving the tube and for catching the thread, a powered winding roller for rotating the tube or the bobbin along with a thread traversing device. The work station is equipped with a first suction nozzle that is directed towards the bobbin circumference and also with a second suction nozzle that is arranged on the side of the bobbin plate turned away from the package and is directed essentially counter to the first suction nozzle and is spaced apart from it.

In accordance with the invention, the thread is arranged for attachment on an empty tube in the two suction nozzles, and is tensed in between in particular by means of negative pressure in at least the second suction nozzle. The other end of the thread may pass through the first suction nozzle and may also be held by means of negative pressure or by means of a clamping device, for example between clamping rollers. Instead of the negative pressure, the clamping of the thread may also take place on both sides by means of a clamping device, which is arranged, for example, in the suction nozzles or in the area of the suction nozzles. It is also possible that the thread is in motion through the two suction nozzles, in particular if the spinning device continues to produce during the application of the method and the thread is extracted by suction through the second suction nozzle.

The thread tensed between the two suction nozzles is captured by a catching device, in order to catch the thread and subsequently wind it onto the tube. The catching device engages in the tensed thread and moves it in the direction of the tube, as soon as the bobbin plate rotates. Through the two fixed suction nozzles, the thread can be tensed in a very simple manner. If the thread is then crossed with the winding position, the catching device catches the thread and then may fix it on the tube in such a manner that the thread is wound onto the tube. The process may take place very quickly, because only a few movements are required. Thus, the productivity of the work station may be significantly increased compared to corresponding methods of the state of the art.

If at least the second suction nozzle does not move during the winding and attachment of the thread to the empty tube, a significant simplification of the device, and in particular an even faster handling and winding of the thread on the empty tube, is possible. In a particularly preferred version of the invention, both suction nozzles are not moved; that is, they are arranged in a manner fixed and stationary at the work station. Thus, an even faster fixing of the thread on the empty tube is possible. In this way, the process of the method is simplified and is faster to carry out than with the state of the art.

In a preferred version of the invention, the bobbin plate and/or the tube are at least a part of the catching device. With this, the tensed thread is crossed with the bobbin plate and/or the tube, in order to catch the thread and subsequently wind it onto the tube. By the bobbin plate and/or the tube and the thread being crossed with each other, the bobbin plate and/or the tube is able to grip the thread and ensure that the thread is subsequently wound onto the tube. For this purpose, the bobbin plate may have different known characteristics. For example, a hook-shaped formation of the bobbin plate is suitable, whereas the corresponding hook can grip the tensed thread and move it in the direction of the tube, as soon as the bobbin plate rotates. If the thread is then crossed with the winding position, the hook catches the thread and then may fix it on the tube in such a manner that the thread is wound onto the tube. Alternatively, the thread may be crossed with the tube. Herein, with correspondingly prepared (for example, slotted or roughened) tubes, it is either clamped, and thereby caught, on these or alternatively between the tube and the bobbin plate.

If the thread is guided between the two suction nozzles by means of a guide device, it may be tensed in a suitable manner in order to be captured safely and easily by the bobbin plate. The guide device may also be provided such that the thread is sufficiently tensed in order to reliably ensure the gripping of the thread by the bobbin plate.

If the thread is tensed by means of the guide device essentially transverse to the bobbin plate, the bobbin plate may simply and reliably capture the thread, in particular if it features hooks on the circumference.

If the bobbin plate is lowered in the direction of the winding roller, or if the guide device is to be moved in the radial direction towards the bobbin plate, so that the thread between the two suction nozzles that is tensed by means of the guide device at an angle, in particular essentially transverse to the bobbin plate, is crossed with the bobbin plate, a rapid and reliable capturing of the thread by means of the bobbin plate and a subsequent winding of the thread on the tube is likewise ensured. In particular if the bobbin holder is lowered, the guide device may be very easily formed. In this case, a movement of the guide device for feeding the thread at the bobbin plate is not required. The bobbin plate moves upon the lowering of the tube to a winding roller for driving the tube at the same time to the guide device, and thus to the thread tensed on it, and grips the thread. This makes it possible that both the two suction nozzles and the guide device can be carried out in a stationary manner, or at least the guide device, after the transfer of the thread, must be moved only slightly from the area of the bobbin plate.

If the guide device is moved away from the bobbin plate after the attaching of the thread on the empty tube, it is ensured that the guide device does not hinder the winding of the thread on the tube and/or the formation of the package. However, this movement takes place after the transfer of the thread to the bobbin plate, and may take place after the beginning of the production of the thread or the rewinding of the thread, and thus does not lead to a prolongation of the working cycle.

In an advantageous version of the invention, the thread coming from an auxiliary bobbin of a maintenance device or from the package previously finished at this work station or from the spinning device is brought between the two suction nozzles and is sucked in by the two suction nozzles. Thus, the thread is located in the two suction nozzles and may be accordingly stretched in the gap between the two suction nozzles. In particular, if the thread comes from the spinning device and is further produced, an on-the-fly change from the full bobbin to an empty tube may thereby take place.

If the thread is sucked in only by the first suction nozzle and then by the second suction nozzle, it may be positioned in the respective suction nozzle with predetermined lengths.

In the use of the thread of an auxiliary bobbin of the maintenance device, an attachment of the thread is possibly to be carried out, even if no thread is available at the respective work station. Thus, this method is very flexible. On the other hand, if the thread is used which is coming from the package previously completed at this work station, the work station can carry out a change of the bobbin to an empty tube, without a corresponding maintenance device being necessary. Thus, the work station may commence with the winding on a new tube independently, without relying on a maintenance device. With this, the thread is removed from the finished package and is inserted into the first and second suction nozzle, or if it is already in the first suction nozzle, only into the second suction nozzle. After severing the thread, the full bobbin is replaced with an empty tube. The thread piece located in the two suction nozzles may then be used for piecing or for connecting with a thread of a supplied cop, and for attaching to the tube.

If the thread from the maintenance device is inserted into the two suction nozzles, the design complexity of the individual work stations of the machine is reduced. This relatively rare intervention may be performed by the maintenance device, which features all the necessary handling devices, without these always having to be present at each workstation. If the thread is inserted into both suction nozzles by a maintenance device, a targeted feeding of the thread from the auxiliary bobbin or from the package previously finished at that work station to the guide device takes place, in order to ensure the proper gripping by the catching device.

As the thread has been attached to the empty tube, the thread is severed and the thread end protruding into the second suction nozzle is extracted by suction. The thread is then wound onto the tube. It is thereby ensured that no thread end protrudes beyond the bobbin, and thereby could result in damage to the bobbin. In a preferred version, during the winding onto the package, the thread is guided through the first suction nozzle.

If, after being attached to the empty tube, the thread oscillates by means of the guide device or is transferred to a traversing device, the normal winding of the bobbin may then take place. If the thread oscillates by means of the guide device (that is, the guide device is part of the traversing device), this leads to a structurally very simple version of the invention. Thereby, a transfer of the guide device to the traversing device is not required. This may take place, for example, in such a manner, that the guide device and/or traversing device is capable of being moved beyond the normal traversing path, which is necessary for the winding of the bobbin, in order to tense the thread between the two suction nozzles. As soon as the normal winding of the bobbin occurs, the traversing thread guide moves within the traversing path of the package.

Alternatively, it is also possible that the guide device and the traversing device are separate components. Thereby, a transfer of the thread from the guide device to the traversing device is required. This may take place by means of a corresponding geometry of the guide device; that is, that the thread falls out of the guide device as soon as it has been severed. Alternatively, through a corresponding movement of the guide device, the thread can be dropped onto the traversing device.

A work station in accordance with the invention of a spinning machine and/or a winding machine has a spinning device for producing a thread and/or a cop for delivering a thread along with a winding device for producing a package on a tube. The winding device features a swivel-mounted bobbin holder with a bobbin plate for receiving the tube and for catching the thread, a powered winding roller for rotating the tube and/or the bobbin along with a thread traversing device. The work station is equipped with a first suction nozzle that is directed towards the bobbin circumference and also with a second suction nozzle that is arranged on the side of the bobbin plate turned away from the package and is directed essentially counter to the first suction nozzle and is spaced apart from it. In accordance with the invention, the two suction nozzles are arranged at each other in such a manner that the thread for the attachment to an empty tube that is located in the two suction nozzles can be tensed between the two suction nozzles by means of negative pressure in at least the second suction nozzle in such a manner that it can be captured by a catching device. Thereby, the thread can be caught and subsequently wound onto the tube.

Through the arrangements of the suction nozzles in accordance with the invention, the thread is tensed between the suction nozzles. The two suction nozzles suck in the thread in opposite directions, such that it is tensed between the two suction nozzles. Alternatively, it is also possible that the thread is clamped in the area of the first suction nozzle and is sucked in by the second suction nozzle, or conversely is also clamped in the two suction nozzles or in the area of the two suction nozzles. Thereby, a tension on the thread also arises. By means of the catching device, the thread is gripped and can be wound onto the tube.

It is particularly advantageous if at least the second suction nozzle, preferably both suction nozzles, is/are arranged in an immovable manner. Thereby, the two suction nozzles arranged in a stationary manner provide for a very simple version of the work station in accordance with the invention. Devices for moving and guiding the suction nozzles are not necessary. Both suction nozzles can be fixed to the work station, and the thread is guided through the two suction nozzles. Of course, it is also possible that one or both suction nozzles is formed in a movable (for example, pivotable or displaceable) manner.

In a preferred version of the invention, the thread piece located between the two suction nozzles is crossed with the bobbin plate and/or the tube. Herein, the bobbin plate and/or the tube are at least a part of the catching device, and the tensed thread can be caught and subsequently wound onto the tube. Thereby, in a targeted manner, the thread can be brought into the area of the bobbin plate or the tube, or conversely the bobbin plate or the tube can be brought into the area of the tensed thread. Thereby, the thread can be captured and wound onto the tube.

If a guide device for guiding the thread is provided between the two suction nozzles, the thread may be arranged in a manner essentially transverse to the bobbin plate. The guide device ensures that the crossing angle between the catching device, for example the bobbin plate, and the tensed thread is such that the thread is ideally positioned in accordance with the catching device. Preferably, the bobbin plate has a toothed circumference, whereas the teeth can engage the tensed thread and bring it to the tube. As an alternative to such teeth, a longitudinally oriented recess on the bobbin plate, on the tube or between the tube and the bobbin plate may be provided, in which the thread is clamped. In this case, it is advantageous if the thread is substantially aligned parallel to the bobbin plate. In such a case, the crossing angle is very low.

In a preferred version of the invention, the guide device is arranged in a movable manner in a radial direction towards the bobbin plate at and/or away from it. Thus, the guide device may move the tensed thread either in the direction of the bobbin plate or, after the gripping of the thread, out of the area of the bobbin plate, in order for the subsequent winding of the thread on the package not to be hindered.

It is particularly advantageous if the guide device is arranged on the first suction nozzle or its housing. In this case, the guide device may be precisely arranged in relation to the package on the bobbin circumference of which the first suction nozzle is directed.

If the guide device is a part of a movable mouth of the first suction nozzle, the feeding of the thread to the catching device or the moving away of the guide device after the transfer of the thread to the catching device may be realized very easily.

If the guide device is formed with a hook shape, the thread may be, in a very simple manner, placed around the hook or hooks of the guide device and sucked in by at least the second suction nozzle and thereby tensed.

In order to create a particularly simple version of the invention, it is advantageous if the guide device is simultaneously a traversing thread guide. In this case, the traversing thread guide is guided out of the traversing path for the package, and in that place serves as a guide device for the thread.

If a maintenance device that serves the purpose of the insertion of the thread into the two suction nozzles is provided, a thread may also be fed, for example, by an auxiliary bobbin, which is located on the maintenance device. The piecing and attachment of the thread may thereby take place without a correspondingly necessary thread end being located at the work station. The maintenance device that patrols along a multiple number of workstations feeds such thread end from the auxiliary bobbin that is carried along to the work station or to the suction nozzles.

If a severing device is arranged on the work station, in order to sever the thread after the attachment at the empty tube, the severed thread end can be extracted by suction through the second suction nozzle. On the package, there is no overhanging thread end that could lead to damages to the package.

BRIEF DESCRIPTION OF THE DRAWINGS

Further advantages of the invention are described in the following embodiments. The following is shown.

DETAILED DESCRIPTION

Figures 1A, 1B, 1C:
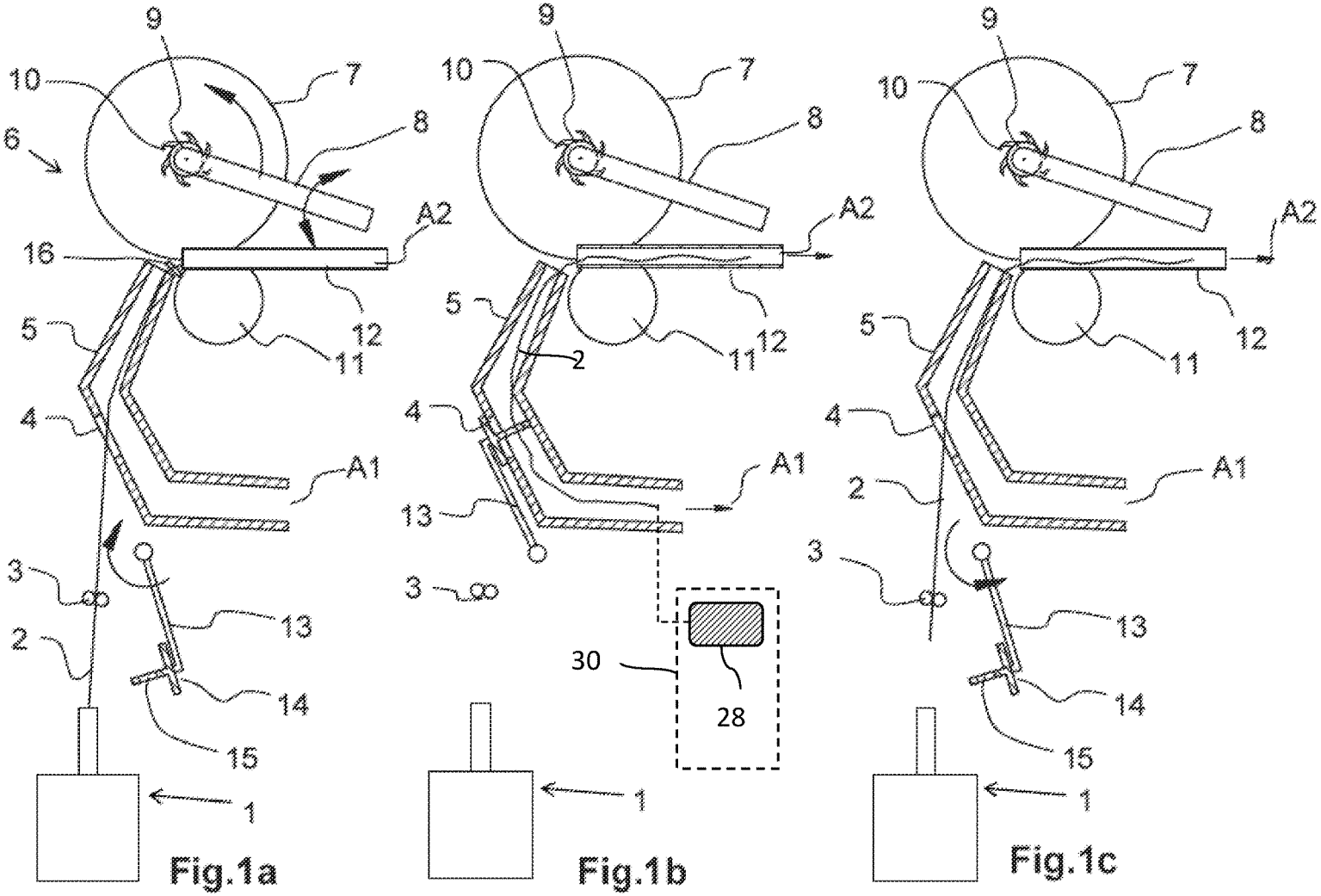
FIG. 1*a*-1*c* are a side view of a spinning/winding machine with a section through two suction nozzles.

Reference will now be made to embodiments of the invention, one or more examples of which are shown in the drawings. Each embodiment is provided by way of explanation of the invention, and not as a limitation of the invention. For example features illustrated or described as part of one embodiment can be combined with another embodiment to yield still another embodiment. It is intended that the present invention include these and other modifications and variations to the embodiments described herein.

FIGS. 1*a* to 1*c* show a side view of an outlined work station of a spinning/winding machine, such as a rotor spinning machine or an air jet spinning machine, in which two suction nozzles are shown in sectional view. The following embodiments refer to a catching device that is equipped by means of a toothed bobbin plate. A catching device that is located on the tube or between the tube and the bobbin plate operates analogous to the following description. Herein, the positioning of the thread with respect to the catching device can be modified such that the corresponding catching device is able to capture the thread easily and reliably.

FIG. 1*a* shows the spinning/winding machine during production. In a spinning device 1, a thread 2 is produced and is drawn out from the spinning device 1 by means of powered draw-off rollers 3. The thread 2 runs through an opening 4 of a first suction nozzle 5 through this first suction nozzle 5 and arrives at a winding device 6. The winding device 6 features a bobbin 7 on which the thread 2 is wound. The bobbin 7 is held in a bobbin holder 8. The bobbin holder 8 is swivel-mounted according to the direction of the double arrow and is adjusted to the current diameter of the bobbin 7. In addition, it is able to raise or lower the bobbin 7 or the tube presented in the following figures where necessary. A bobbin plate 9, which features teeth 10, is arranged on the bobbin holder 8, which surrounds the bobbin 7 and the tube 18 on both sides. The teeth 10 serve the purpose of catching the thread 2, as will be described in more detail below. For the rotation of the bobbin 7 in the direction of the arrow, it attaches to a winding roller 11, which is powered. The thread 2 is located in a thread guide 11, which oscillates back and forth in front of the bobbin 7 and winds the thread 2 crosswise onto the bobbin 7.

A second suction nozzle 12, which is directed counter to the first suction nozzle 5, is arranged at the side of the bobbin 7. The two mouths of the first suction nozzle 5 and the second nozzle 12 are essentially opposed to each other, even if they can be offset to each other laterally with a viewing direction towards the winding surface of the bobbin 7. As will be described below, the thread 2 is tensed between the two mouths in a manner corresponding to the method in accordance with the invention.

A holder 13, which is rotatably mounted, is provided in the area of the draw-off rollers 3. A seal 14 and an eyelet 15 are arranged on the holder 13. The seal 14 is provided for the purpose of sealing the opening 4 of the first suction nozzle 5, while the eyelet 15 is located within the first suction nozzle 5 or if the first suction nozzle 5 at the mouth is to feature a suction force for attracting and holding the thread 2.

The first suction nozzle 5 is connected to a first extraction port A1 and the second suction nozzle 12 is connected to a second extraction port A2. Both extraction ports A1 and A2 can be independently switched on and off. In the presentation of FIG. 1*a*, the two extraction ports are switched off, since the thread 2 passes directly from the spinning device 1 through the opening 4 and the upper part of the first suction nozzle 5 to the winding device 6 and is wound onto the bobbin there 7. In this state, a suction force of the first suction nozzle 5 at the thread 2 is not required.

In the presentation of FIG. 1*b*, in comparison to FIG. 1*a*, the holder 13 is swiveled upwards and, with the seal 14, closes the opening 4. Both extraction ports A1 and A2 are switched on. The thread 2 is located with one end in the first suction nozzle 5 and with the other end in the second suction nozzle 12. The thread 2 passes through the eyelet 15 of the holder 13. The thread 2 in FIG. 1*b* originates, for example, from an auxiliary bobbin 28, which was brought by a maintenance carriage 30 (schematically shown) to the corresponding work station. At that point, by means of corresponding handling elements, the maintenance carriage has inserted a thread end into the two suction nozzles 5 and 12. The thread 2 is no longer located in the thread guide 16, and thus no longer oscillates. Alternatively, the insertion of the thread 2 into the two suction nozzles 5 and 12 may be carried out by hand.

In FIG. 1*c*, the holder 13 is swiveled back downwards and has a thread end that was previously located in the first suction nozzle 5, pulled through the opening 4 and inserted between the two draw-off rollers 3. Thus, the thread 2 is fixed by the draw-off rollers 3. Through the rotation of the draw-off rollers 3, the thread 2 may be moved in its longitudinal direction. The other end of the thread 2 is also located in the second extraction port 12 and is held in this suction nozzle 12 by the suction force.

In the method step in accordance with FIG. 1*b*, or only in or after the method step in accordance with FIG. 1*c*, the bobbin 7 may be replaced with an empty tube 18.

In the further description, the method in accordance with the invention is more specifically described. FIGS. 2*a* to 2*f*, along with 3*a* to 3*h*, show a top view of the winding device 6.

Figure 2B:
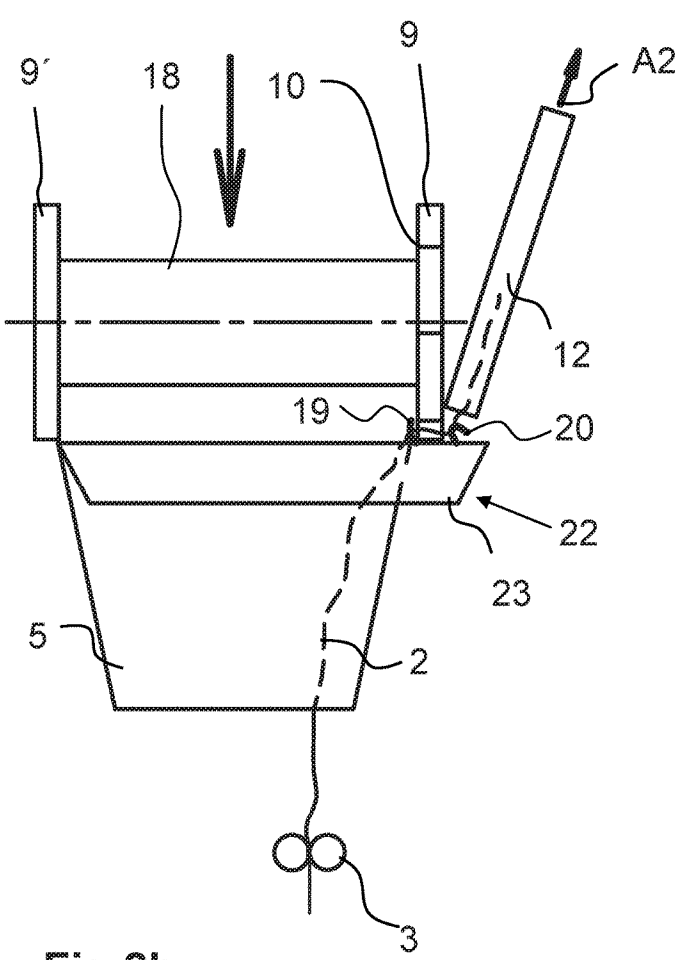
FIGS. 2*a*-2*f* are the method steps for attaching a thread to an empty tube with an assisting thread in accordance with a first version of the device.
Figure 2A:
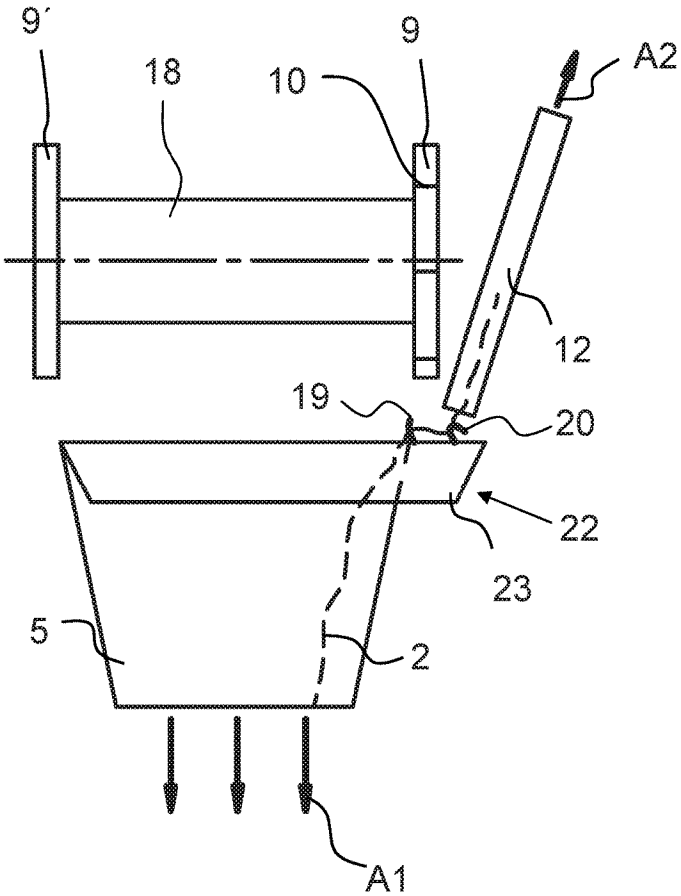

The presentation of FIG. 2*a* essentially corresponds to the situation as shown in FIG. 1*b*. The two extraction ports A1 and A2 are turned on and the thread 2 is located with two ends both in the first suction nozzle 5 and in the second suction nozzle 12.

A tube 18 is held between two bobbin plates 9. On its circumference, the bobbin plate 9 features teeth 10, with which the thread 2 can be caught. On the other hand, the opposing bobbin plate 9' does not feature any teeth 10, since the thread 2 needs not to be caught at this place. The tube 18 is removed from the first suction nozzle 5 so far that the bobbin plate 9 is not engaged in an area in which the thread 2 passes. For this purpose, the tube 18 is lifted from the winding roller 11 with the bobbin holder 8, which is not shown for reasons of greater clarity.

The thread 2 passes through the first suction nozzle 5 via a first hook 19 to a second hook 20 into the second suction nozzle 12. It is not guided in the thread guide 16 (FIG. 1*a*). The first hook 19 and the second hook 20 are parts of a guide device 22, which guides the thread 2 for re-attachment at the tube 18. The two hooks 19 and 20 are attached to one side of a plate 23, which, in this embodiment, is in turn located on the housing of the first suction nozzle 5. The plate 23 may be a type of a mouthpiece of the first suction nozzle 5, which may have other functions, such as the sucking in of a thread end at a bobbin 7 or the lifting of the thread 2 from the thread guide 16.

As already described above, the thread 2 is tensed between the two hooks 19 and 20. Here, the first hook 19 is less curved than the second hook 20. The justification for this is that, at a later point in time of the process of the method, the thread 2 is to slip through the first hook 19, in order to be able to be inserted into the thread guide 16. However, the second hook 20 is more curved, in order to ensure that the thread 2 can be inserted into the mouth of the second suction nozzle 12. Of course, other versions of the hooks 19 and 20 are possible, depending on the circumstances at the individual winding devices 6. The first hook 19 and second hook 20 are spaced so far from each other that the bobbin plate 9 may engage between the two hooks 19 and 20, and may grip the thread 2 there.

The gripping of the thread 2 by the teeth 10 of the bobbin plate 9 is shown in FIG. 2*b*. Here, the tube 18 is lowered to the winding roller 11 of FIG. 1*a* and starts to rotate. The teeth 10 of the bobbin plate 9 are located in the area between the two hooks 19 and 20 and capture the thread 2 that is tensed in between. Herein, the thread 2 is further sucked into the second suction nozzle 12. The other end of the thread 2 is now located between the two draw-off rollers 3 in accordance with FIG. 1*c*. Alternatively, by means of an extraction port A1 of the first suction nozzle 5 that is still switched on, it would also be possible to hold the thread 2 at such end in a tensed manner.

Figure 2D:
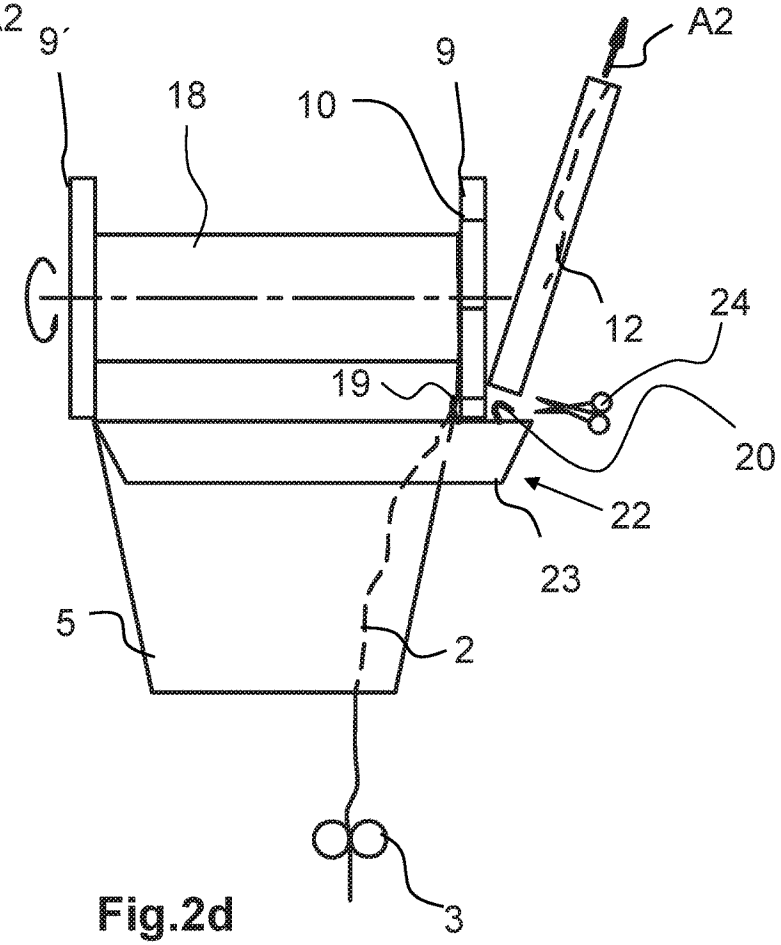
Figure 2C:
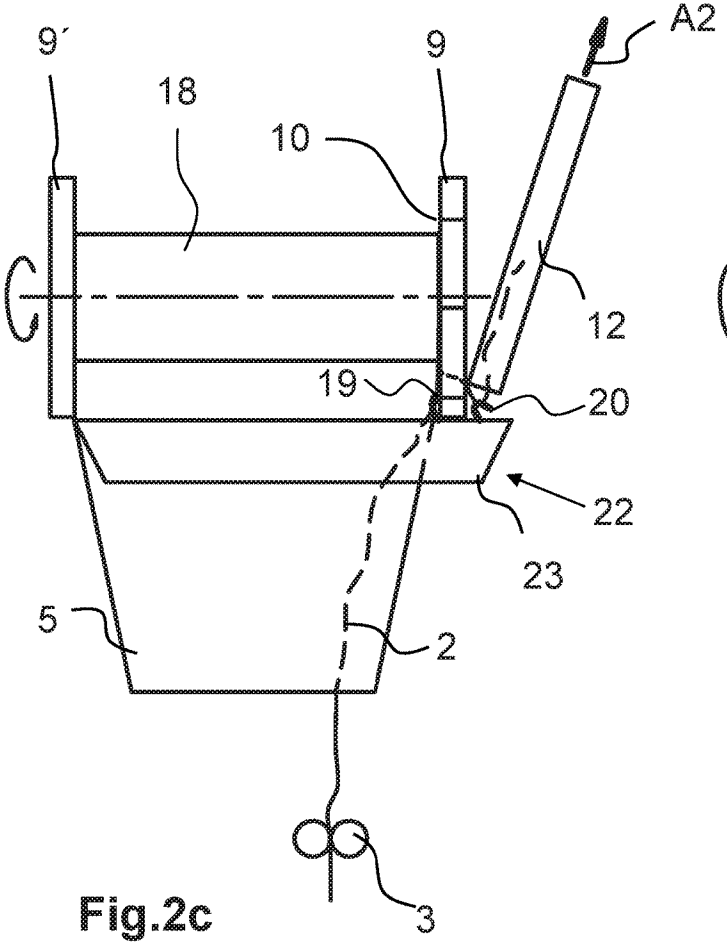

FIG. 2*c* shows that the thread 2, as it was captured by the teeth 10 of the bobbin plate 9, is drawn to the tube 18 and is clamped there between the tube 18 and the bobbin plate 9. Thereby, the thread 2 still runs through the two hooks 19 and 20. If it is fixed at the lower end in the draw-off rollers 3, the other thread end is pulled from the second extraction port 12 against the suction force of the extraction port A2 and provides the length required for clamping at the tube 18. Alternatively, the required thread 2 may be made available by the delivery from the draw-off rollers 3.

In accordance with FIG. 2*d*, the thread end, which is not required for clamping on the tube 18, is severed by means of a severing device 24, which is symbolically represented here as a pair of scissors. The excess thread end is extracted by suction through the extraction port A2 of the second suction nozzle 12. The thread 2 now runs only through the first hook 19 to the tube 18.

Figure 2F:
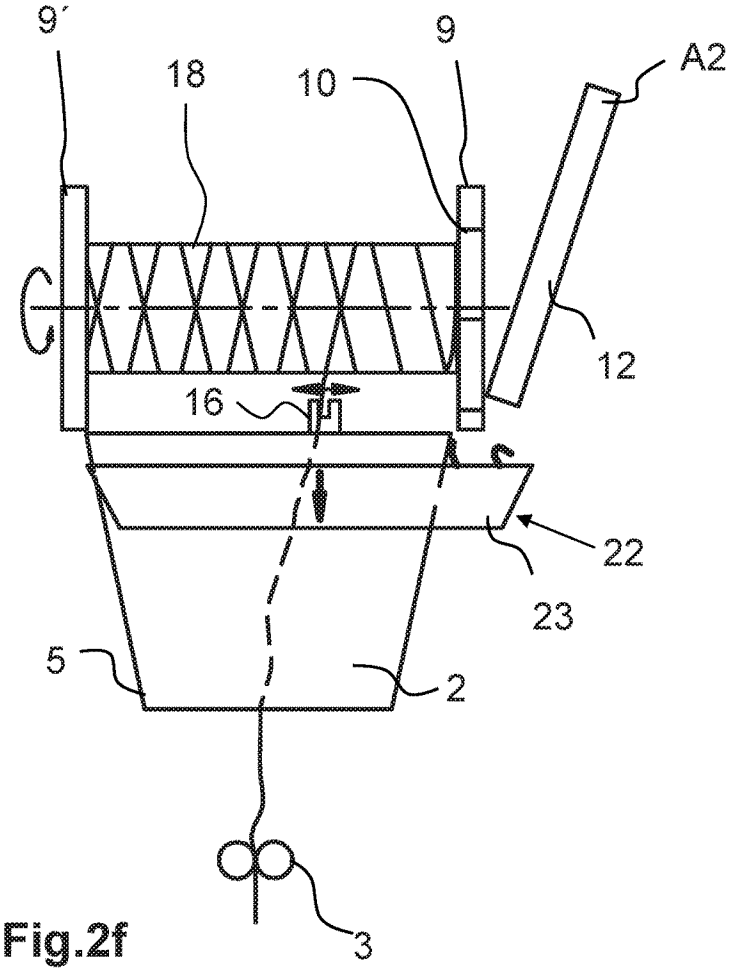
Figure 2E:
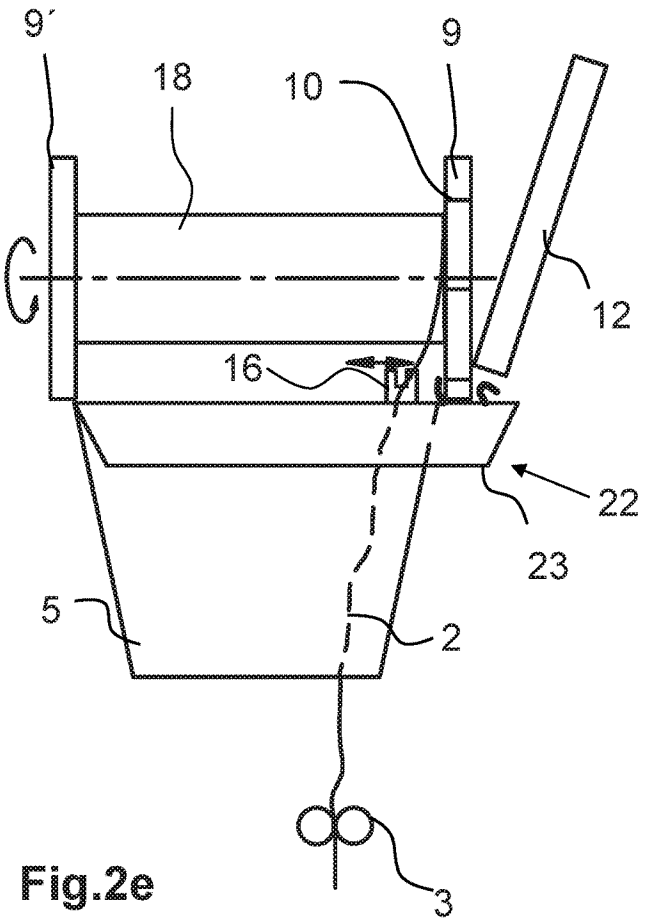

As evident from FIG. 2*e*, the thread 2 is then transferred to the thread guide 16, which oscillates back and forth in front of the tube 18. The thread guide 16 was previously positioned outside of the engaging area of the thread 2, in order not to hinder the previous processing steps. Upon delivery, the thread 2 slides down from the hook 19. The transfer may be effected, for example, by means of a movement of the plate 23, by which the thread 2 slips down from the hook 19 or also through the movement of the thread guide 16, which is driven in the course of the thread 2 and, at that point, exercises drag forces on the thread 2 that are higher than the hook 19 features restraining forces.

The thread 2 now begins to oscillate back and forth on the tube 18, as evident in FIG. 2*f*. In order not to hinder the further bobbin structure, the plate 23 with the hooks 19 and 20 moves away from the tube 18. For this purpose, it makes sense that the housing of the first suction nozzle 5 serves as the guide.

The re-attachment of the thread in the spinning device 1 preferably occurs during the method step 2*d*. After the re-attachment of the thread 2 in the spinning device 1, the thread 2 is produced again; in accordance with the presentations of FIGS. 2*e* and 2*f*, it is wound onto the tube 18.

FIGS. 3*a* to 3*h* show a method that is modified compared to FIGS. 2*a* to 2*f*. A major difference is that the thread end used for re-attaching the thread 2 on a new tube 18 is taken from a bobbin 7 finished at this work station.

Figure 3B:
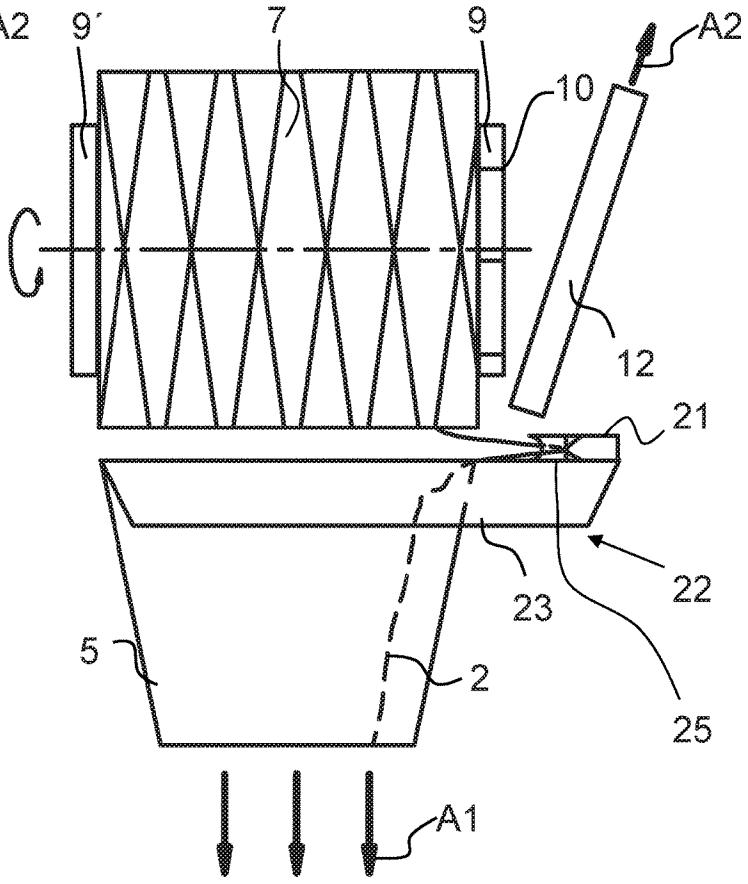
FIGS. 3*a*-3*h* are the method steps for attaching a thread to an empty tube with a thread of a previously wound bobbin with a second version of the device.
Figure 3A:
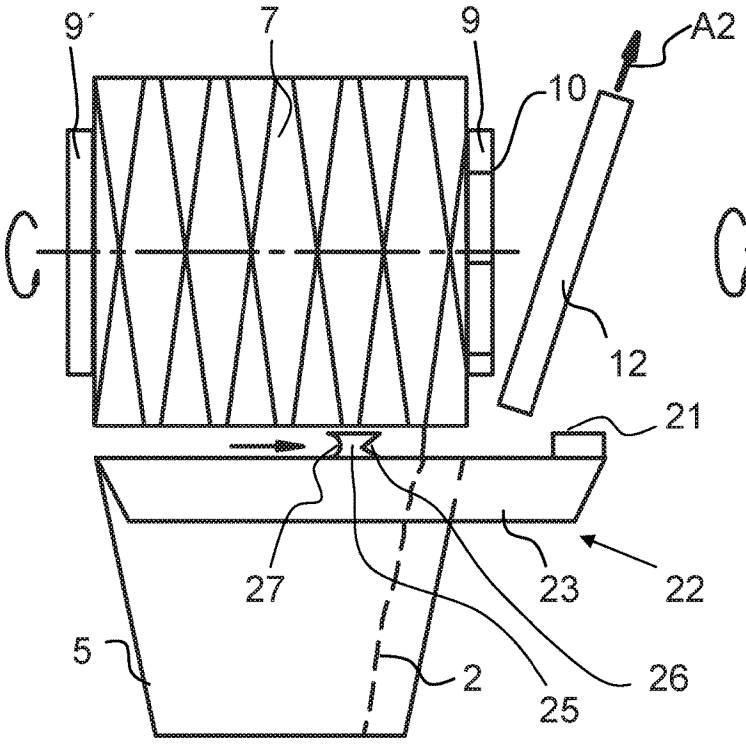

For this purpose, the guide device 22 features a cutting block 21 and a movable guide element 25. The cutting block 21 and the guide element 25 are arranged on the plate 23, which is located on the housing of the first nozzle 5. The guide element 25 features a cutting edge 26 and a guide groove 27. The cutting edge 26 is formed in a V-shape and may thus capture the thread 2 and move towards the cutting block 21. During such movement, the thread 2 is deflected between the bobbin 7 and the mouth of the first suction nozzle 5 and, as soon as the cutting block 21 is reached, is cut. This is shown in FIG. 3*b*.

This figure also indicates that the extraction port A1 via the first suction nozzle 5 is switched on. This is necessary, for example, if the thread is sought on the finished bobbin 7, is found and is to be withdrawn from the bobbin 7. In this case, the thread end that is found is sucked into the extraction port A1 and subsequently, as shown and described in FIGS. 1*b* and 1 *c*, is brought into the engagement of the draw-off rollers 3.

In another case, an on-the-fly bobbin change may take place, with which the thread 2 continues to be produced. Herein, the thread 2 is conveyed by the draw-off rollers 3 into the extraction port A2. In this case, unlike that in FIG. 3*b*, the extraction port A1 is switched off. The thread 2 is either conveyed continuously into the extraction port 12 and is disposed of there. Alternatively, it is possible that the thread 2 is stopped and subsequently must once again be re-attached in the spinning device 1.

Figure 3D:
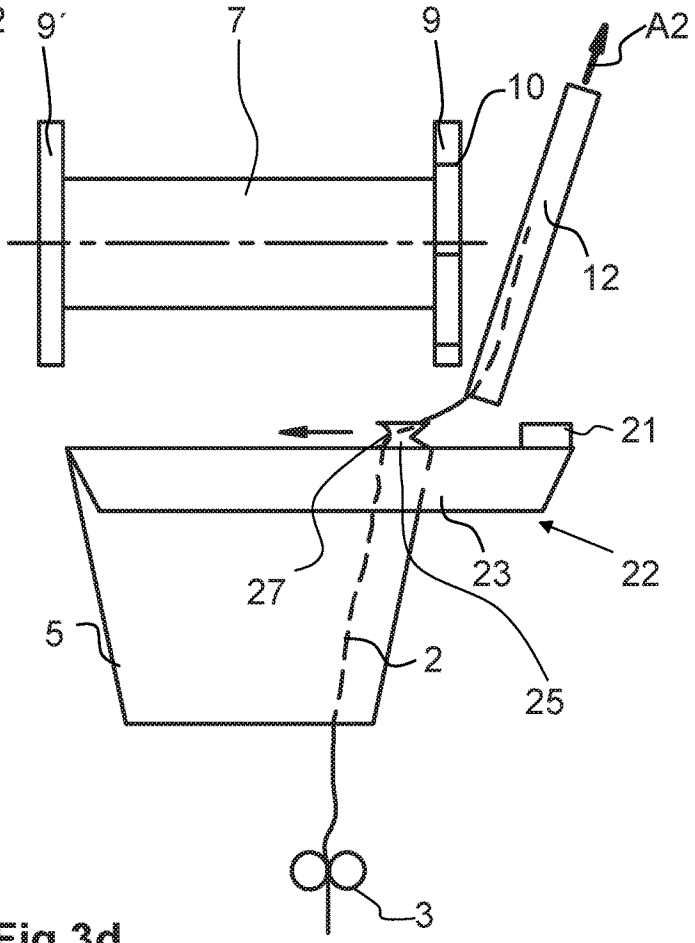
Figure 3C:
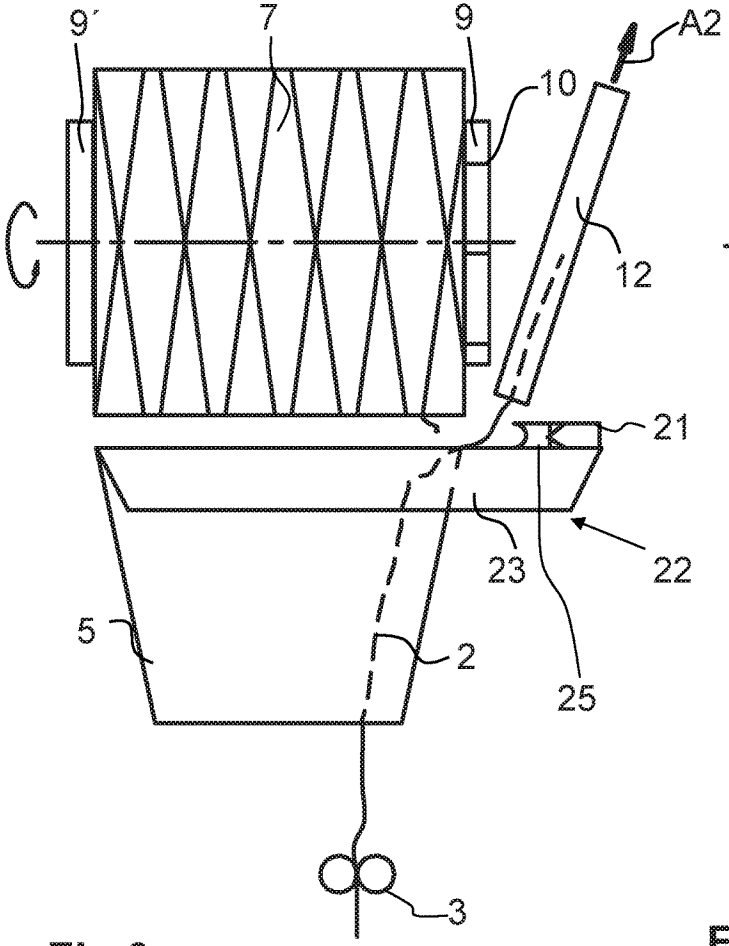
Figure 3F:
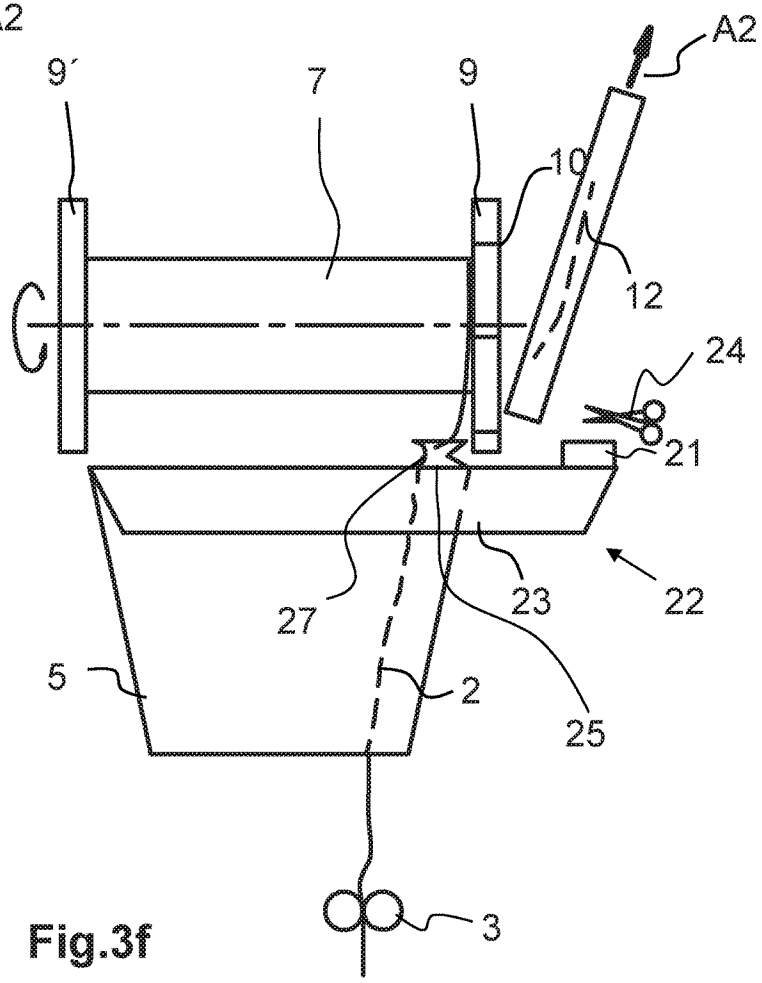

In accordance with FIG. 3*c*, the thread 2 is held or conveyed by the draw-off rollers 3. The thread 2 is now located in the second suction nozzle 12, the extraction port A2 of which is switched on. The other severed thread end passing to the bobbin 7 is wound onto the bobbin 7. The bobbin 7 may then be removed from the winding device 6.

After the bobbin 7 has been exchanged for an empty tube 18 in accordance with FIG. 3*d*, the guide element 25 moves in an opposite direction and, using the guide groove 27, guides the thread 2 away from the cutting block 21. The thread 2 is now tensed between the guide groove 27 and the mouth of the second suction nozzle 12 and opposite to the bobbin plate 9 with the teeth 10.

Figure 3E:
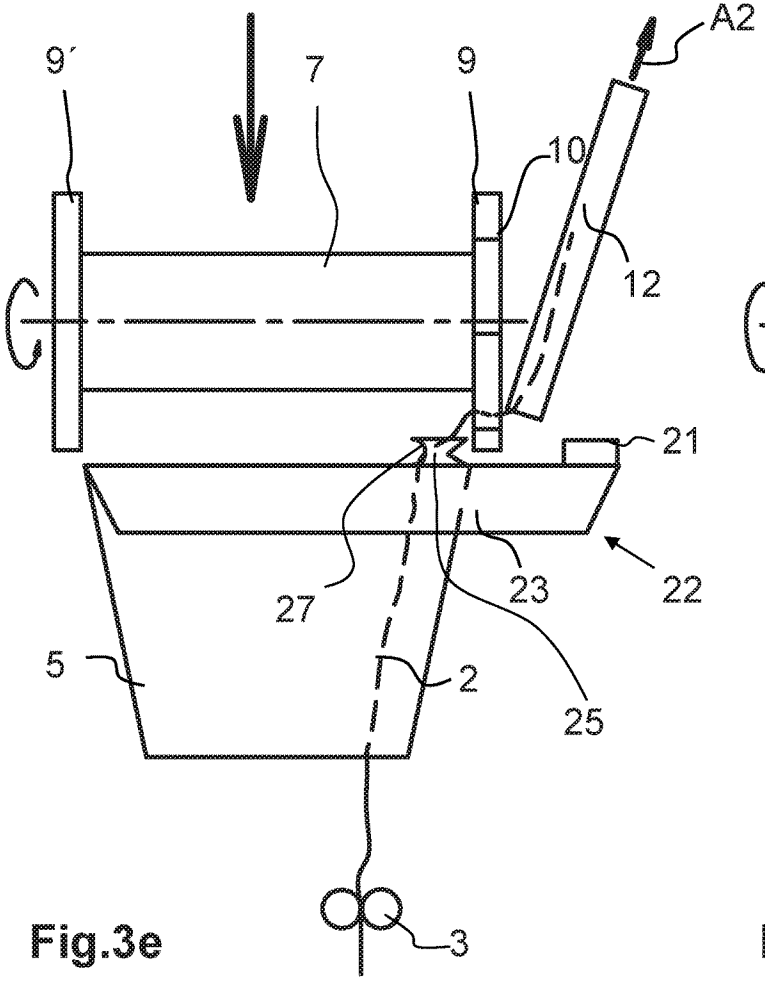

As in FIG. 2*b*, the bobbin holder 8 in accordance with FIG. 3*e* with the tube 18 and the two bobbin plates 9 and 9' lowers to the winding roller 11 (FIG. 1) begins to rotate, and the teeth 10 of the bobbin plate 9 engage in the tensed thread 2 between the guide element 25 and the second nozzle 12. The thread 2 is captured by the teeth 10 and is drawn to the tube 18, and there is fixed between the tube 18 and the bobbin plate 9 in accordance with FIG. 3*f*. The excess thread end that still protrudes into the second suction nozzle 12 is cut off by means of the severing device 24 and is disposed of through the second extraction port A2.

Figure 3H:
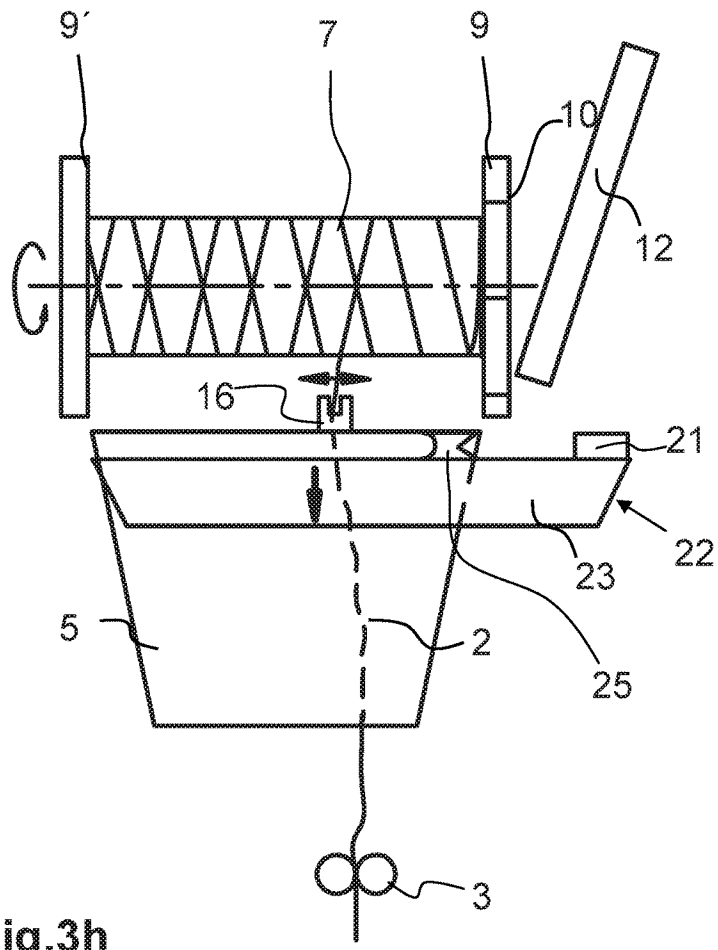
Figure 3G:
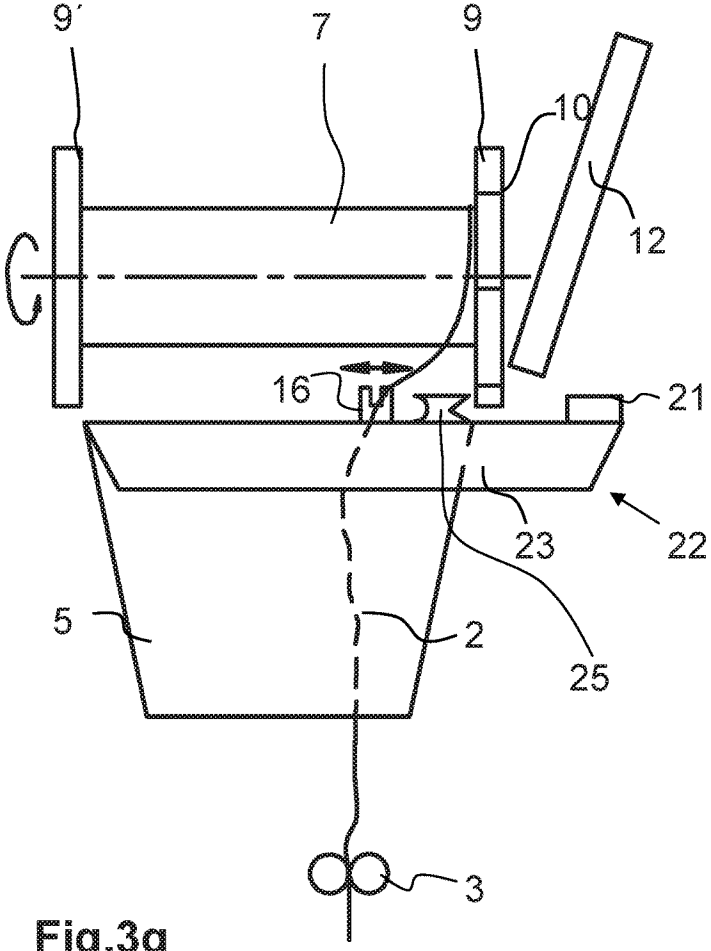

The thread 2 lying in the guide groove 27 is now transferred to the thread guide 16, which oscillates back and forth in front of the tube 18 (FIG. 3*g*). The transfer may be effected, for example, once again by means of a movement of the plate 23, by which the thread 2 slips out of the guide groove 27 or also through the movement of the thread guide 16, which is driven in the course of the thread 2 and, at that point, exercises higher drag forces on the thread 2 than the guide groove 27.

Subsequently, in accordance with FIG. 3*h*, the plate 23 with the guide element 25 and the cutting block 21 is shifted into a position that is removed far from the bobbin 7, in order not to hinder the winding of the thread 2.

Figure 4:
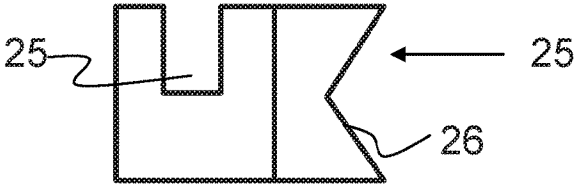
FIG. 4 is an outlined thread guide with a lateral cutting device.

FIG. 4 shows an alternative guide element 25. Herein, the guide groove 27 is arranged such that the thread 2 may oscillate back and forth in front of the tube 18. Thus, the guide groove 27 has the additional function of the thread guide 16. Accordingly, the guide element 25 also remains in the area immediately in front of the bobbin 7 and will not be shifted back from this area in a manner corresponding to FIG. 3*h*. The advantage of this version is that a transfer of the guide element 25 to the thread guide 16 does not have to take place.

Figure 5:
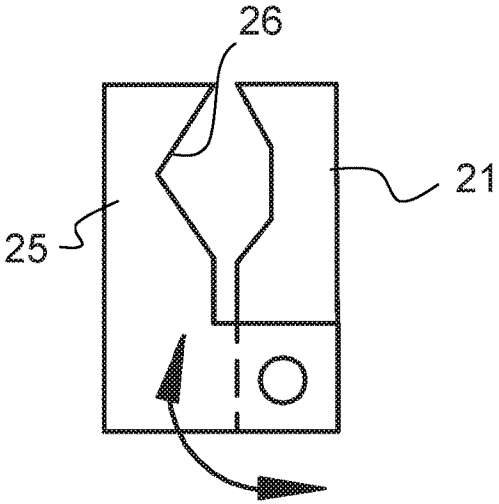
FIG. 5 is an alternative cutting device.

FIG. 5 shows an additional alternative version of the guide device 22. The guide element 25 features only a cutting edge 26. It is rotatably mounted in relation to the cutting block 21. As soon as the thread 2 enters the area between the cutting edge 26 and the cutting block 21, the cutting edge 26 is rotated in the direction of the cutting block 21 and cuts through the thread 2. This version may be advantageous because of its low space requirement.

This invention is not limited to the illustrated and described embodiments. In particular, it must be noted that the presented components are merely outlined and may be different in a specific arrangement. In particular, the bobbin plate 9 and its teeth 10 may be designed differently. Thus, for example, a clamping of the thread 2 may take place by means of a narrow groove passing in parallel to the bobbin plate 9, in which the thread 2 is caught. In this case, the tensioning of the thread 2 must be carried out in such a manner that the thread 2 comes to lie in this groove, if the bobbin holder 8 lowers the tube 18 into the tensed thread 2. Additional variations within the framework of the claims, such as a combination of features, are also possible, even if they are presented and described in different embodiments.

LIST OF REFERENCE SIGNS

1 Spinning device
2 Thread
3 Draw-off rollers
4 Opening
5 First suction nozzle
6 Winding device
7 Bobbin
8 Bobbin holder
9 Bobbin plate
10 Tooth
11 Winding roller
12 Second suction nozzle
13 Holder
14 Seal
15 Eyelet
16 Thread guide
18 Tube
19 Hook
20 Hook
21 Cutting block
22 Guide device
23 Plate
24 Severing device
25 Guide element
26 Cutting edge
27 Guide groove
A1 First suction port
A2 Second suction port

The invention claimed is:

1. A method for operating a work station of a spinning or winding machine, the work station having:
- a spinning device for producing a thread or a cop for delivering the thread;
- a winding device for producing a bobbin on a tube, the winding device having:
  - a swivel-mounted bobbin holder with a bobbin plate for receiving the tube and for catching the thread;
  - a powered winding roller for rotating the tube or the bobbin;
  - a thread traversing device,
- a first suction nozzle directed towards a circumference of the bobbin on the bobbin holder;
- a second suction nozzle arranged on the bobbin plate turned away from the bobbin and spaced from and directed counter to the first suction nozzle, the method comprising:
- for attaching the thread to an empty tube placed on the bobbin holder, arranging the thread in the first and second suction nozzles so that the thread is tensed by negative pressure at least in the second suction nozzle;
- subsequently, capturing the tensed thread between the first and second suction nozzles with a catching device in order to catch the thread for subsequent winding onto the empty tube.

2. The method according to claim 1, wherein at least the second suction nozzle is not moved during the winding of the thread and attachment of the thread to the empty tube.

3. The method according to claim 1, wherein the bobbin plate or the empty tube are part of the catching device, and the tensed thread is crossed by the bobbin plate or the tube to catch the thread.

4. The method according to claim 1, wherein the thread is guided between the first and second suction nozzles by a guide device and is tensed transverse to the bobbin plate.

5. The method according to claim 4, wherein the bobbin plate is lowered in the direction of the winding roller or the guide device is moved towards the bobbin plate so that the tensed thread is crossed by the bobbin plate between the first and second suction nozzles.

6. The method according to claim 4, wherein the guide device is moved away from the bobbin plate after the attaching of the thread on the empty tube.

7. The method according to claim 4, wherein the guide device is the traversing device that is moved beyond its traversing path for the winding of the bobbin in order to tense the thread between the first and second suction nozzles.

8. The method according to claim 1, wherein the thread is delivered from one of an auxiliary bobbin of a maintenance device, from the bobbin previously finished at the work station, or from the spinning device and is brought between and sucked in by the first and second suction nozzles.

9. A work station of a spinning machine or a winding machine, comprising:
- one of a spinning device that produces a thread or a cop that delivers the thread a winding device that produces a bobbin from the thread on a tube, the winding device further comprising:
  - a swivel-mounted bobbin holder with a bobbin plate for receiving the tube and for catching the thread;
  - a powered winding roller for rotating the tube or the bobbin;
  - a thread traversing device,
- a first suction nozzle directed towards a circumference of the bobbin on the bobbin holder;
- a second suction nozzle arranged on the bobbin plate turned away from the bobbin and spaced from and directed counter to the first suction nozzle;
- the first and second suction nozzles arranged relative to each other such that the thread for the attachment to an empty tube on the bobbin holder is arranged in and tensed between the first and second suction nozzles by negative pressure in at least the second suction nozzle; and
- a catching device, wherein the tensed thread is captured between the two suction nozzles in order to catch the thread with the catching device and subsequently wind the thread onto the empty tube.

10. The work station according to claim 9, wherein the second suction nozzle is non-movably fixed at the work station.

11. The work station according to claim 9, wherein the bobbin plate or the empty tube are part of the catching device, and the tensed thread is crossed by the bobbin plate or the tube to catch the thread.

12. The work station according to claim 9, further comprising a guide device arranged between the first and second nozzles to guide the thread transverse to the bobbin plate.

13. The work station according to claim 9, wherein the guide device is arranged in a movable manner in a radial direction towards and away from the bobbin plate.

14. The work station according to claim 12, wherein the guide device is configured on the first suction nozzle.

15. The work station according to claim 12, wherein the guide device comprises a hook shape.

16. The work station according to claim 12, wherein the guide device is configured with the thread traversing device.

17. The work station according to claim 9, further comprising a maintenance device that inserts the thread into the first and second suction nozzles.

* * * * *